United States Patent [19]

Hobart, Jr.

[11] 4,447,109

[45] May 8, 1984

[54] CONNECTOR PIN

[75] Inventor: Floyd E. Hobart, Jr., Ironia, N.J.

[73] Assignee: Western Electric Company, Inc., New York, N.Y.

[21] Appl. No.: 385,180

[22] Filed: Jun. 4, 1982

[51] Int. Cl.[3] ..... H01R 4/02

[52] U.S. Cl. ..... 339/256 R; 339/217 S; 339/275 B; 339/278 C

[58] Field of Search ..... 339/256 R, 258 R, 258 P, 339/275 B, 275 T, 278 C, 217 S

[56] References Cited

U.S. PATENT DOCUMENTS

| | | | |
|---|---|---|---|
| 3,047,832 | 7/1962 | Deakin | 339/256 R |
| 3,311,866 | 3/1967 | Williamson | 339/217 S |
| 3,663,922 | 5/1972 | Foust, Jr. et al. | 339/17 F |
| 3,697,927 | 10/1972 | Kunkle et al. | 339/176 M |
| 3,853,389 | 12/1974 | Occhipinti | 339/258 R |
| 3,998,518 | 12/1976 | Mathe | 339/217 S |
| 4,140,361 | 2/1979 | Sochor | 339/176 M |
| 4,298,242 | 11/1981 | McKee | 339/258 R |

FOREIGN PATENT DOCUMENTS

| | | | |
|---|---|---|---|
| 2033071 | 1/1971 | Fed. Rep. of Germany | 339/256 R |
| 2639560 | 3/1977 | Fed. Rep. of Germany | 339/278 C |

OTHER PUBLICATIONS

Cinch Advertisement, Oct. 1965.

*Primary Examiner*—John McQuade
*Assistant Examiner*—Gary F. Paumen
*Attorney, Agent, or Firm*—R. F. Kip, Jr.

[57] ABSTRACT

An electrical connector pin is formed from a unitary piece of strip so as to be in the shape of an elongated tubular member with terminal and contact sections at opposite ends, and with an unbonded seam extending between those sections. The terminal section has in it a scoop depression adapted to receive a lead and solder for bonding the lead to the pin, the wall portion which bounds the scoop being interposed between the scoop's interior and the seam to prevent solder in the scoop from reaching the seam and wicking therealong. The pin is adapted to be inserted into the insulating support member of a multi-pin connector, and the pin has forward and reverse motion stop tabs for locking the pin in place in such member. The contact and terminal sections of the pin are selectively coated with, respectively, a corrosion resistant layer and a solderability promoting layer.

10 Claims, 8 Drawing Figures

CONNECTOR PIN

TECHNICAL FIELD

This invention relates generally to electrical connectors of the jack or plug type and, more particularly, to connectors in the form of pins adapted for use in multi-pin jack connectors or plug connectors as well as for other uses.

BACKGROUND OF THE INVENTION

In the manufacture of multi-pin connectors, it has been often found expedient to use, in place of connector pins made with screw machines, connector pins originally constituted of a unitary piece of an elongated strip of electroconductive material which is formed into pin shape by successive operations performed at successive stations along the strip while the piece is still attached thereto. Connector pins so made from strip provide the advantages over connectors made by screw machines of using less material and of having lower manufacturing costs.

In the manufacture of connector pins of strip origin, the piece from which the pin is made is, in order to arrive at the pin shape, rolled or otherwise formed into a longitudinally elongated, partly or wholly tubular member providing at opposite ends thereof (a) a resilient contact section for making contact with another connector and (b) a terminal section for attachment of the pin to a wire lead or leads, the member having also (c) a hollow mid-section between such contact and terminal sections. Because such piece is so formed into the pin, the strip material of which the pin is made does not peripherally extend continuously around its mid-section but, instead, is interrupted by a discontinuity in the form of an unbonded seam extending over the mid-section of the member from its terminal section to its contact section.

The presence of that seam creates the problem that, when it is attempted to connect the terminal section of the pin to a wire lead by soldering, the solder tends to wick along the seam into the contact section of the pin so as to either destroy the resiliency of its contact part or to form an inseparable bond with a mating connector or to produce an open circuit. Wicking of solder flux along such seam may also create difficulties. As a result, connector pins made from strip have been mostly used in multi-pin connectors only when the pin is designed for attachment to a lead in a manner other than by soldering as, for example, by "insulation displacement" wherein the terminal section of the pin has sharp tangs which penetrate the insulation covering of the lead so as to thereby make a mechanical and electrical contact with the wire therein. In instances where the pins must be connected to leads by solder, the prevailing practice still is to have such pins made by screw machines so as to thereby avoid having an unbonded seam and the attendant difficulties caused by its presence.

SUMMARY OF THE INVENTION

In accordance with one aspect of the invention, a solderable connector pin made from strip material is realized by forming the terminal section of the pin to have therein a trough for reception of solder and, further, by also forming such terminal section to provide a barrier adapted to inhibit liquid material in such trough from reaching the unbonded seam of the pin and wicking therealong into the pin's contact section. In this way, the advantages of a pin made from strip may be obtained consonant with such pin also being readily solderable.

According to the invention in one or more other of its aspects, the pin may be provided with stop means such that mere insertion of the pin into a support member causes the pin to be anchored therein, and/or the pin may be conveniently provided during its manufacture with either one or both of a corrosion resistant layer and a solderability promoting layer, which layer or layers cover only part of the pin so as to thereby lower its cost. Of course, the invention is not necessarily limited to only the one or more of the aspects just mentioned.

BRIEF DESCRIPTION OF THE DRAWINGS

For better understanding of the invention, reference is made to the following description of exemplary embodiments thereof, and to the accompanying drawings wherein.

Figure 1:
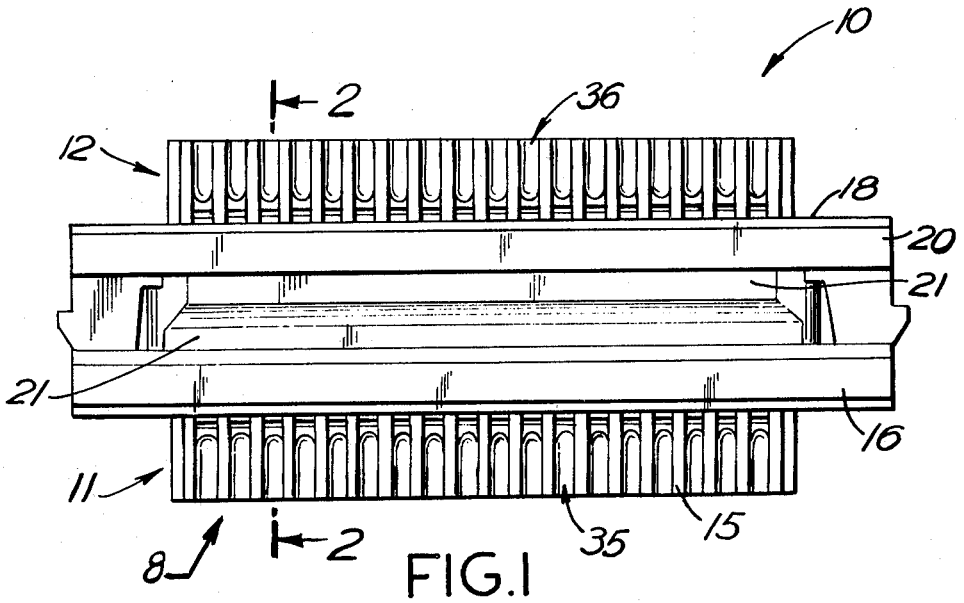
FIG. 1 is a front elevation of a multi-pin connector assembly constituted of multi-pin jack and plug connectors each incorporating connector pins according to the invention.

In the disclosure which follows, a description of any element identified by a reference numeral followed by a suffix for that numeral is, unless the context otherwise requires, to be taken also as a description of any other element having the same reference numeral but a different suffix therefor. It is also to be understood that, while the exemplary embodiments of the invention disclosed herein may be described in terms of a certain spatial orientation therefor, connector pins according to the invention are not limited to any particular spatial orientation.

DESCRIPTION OF EMBODIMENT

Figure 2:
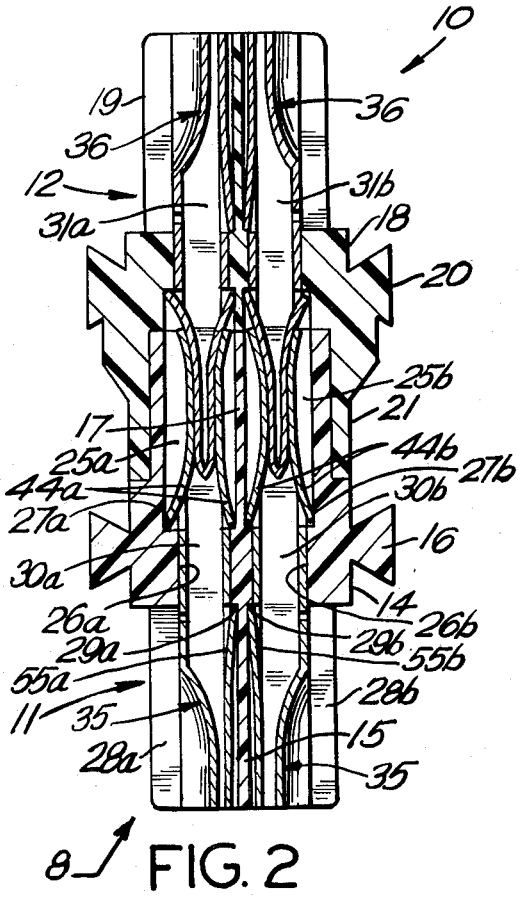
FIG. 2 is a cross-section of the connector of FIG. 1, taken as indicated by the arrows 2—2 in FIG. 1, the cross-section passing through male connector pins and female connector pins according to the invention in, respectively, the jack and plug multi-pin connectors of the FIG. 1 assembly.

Referring now to FIGS. 1 and 2, the reference numeral 10 designates a multi-pin connector assembly consisting of a lower multi-pin jack connector 11 and an upper multi-pin plug connector 12. Connectors 11 and 12 are shown in mutually assembled relation in FIGS. 1 and 2, but are detachable from each other by relative vertical separating movement of the connectors.

The jack connector 11 comprises a horizontally elongated insulating support member 14 having as integral parts thereof a lower terminal block 15, a central base portion 16 horizontally longer and wider than block 15 and an upper matrix block 17 having transversely spaced rounded ends and smaller in its horizontal dimensions than is base portion 16. The plug multi-pin connector 12 comprises an insulating support member 18 which is horizontally elongated and which includes, an integral parts thereof, an upper terminal block 19, a central base portion 20 of greater horizontal dimensions than element 19, and an apron 21 depending from the base 20 and extending around the matrix block 17 so as to be press fitted therewith to thereby maintain the connectors 11 and 12 in attached relation. The insulating members 14 and 18 of such two connectors resemble in respects the corresponding members of the connectors of a multi-pin jack-plug connector assembly commercially available from the Cinch Division of the TRW Corporation.

The matrix block 17 of the jack connector member 14 has formed therein towards its front a set of transversely spaced vertical molded passages 25*a* of square cross section communicating at their lower ends with corresponding vertical square cross-sectional molded passages 26*a* formed in the member's base portion 16 to be smaller in dimension than passages 25*a*. Accordingly, the upper openings of the lower passages 26*a* are surrounded by rims 27*a* partly closing the bottoms of the upper passages 25*a*. Passages 26*a* communicate at their lower ends with a set of corresponding vertical slots 28*a* of rectangular cross-section which are formed in the terminal block 15 of member 14 so as to be open towards the front and bottom of that member. The laterally inner walls of slots 28*a* are disposed inward of the inner walls of the passages 26*a* such that downwardly facing shoulders 29*a* are formed at the tops of those slots between their inner walls and the inner walls of such passages. Each vertically aligned passage 25*a*, passage 26*a* and slot 28*a* forms in and towards the front of member 14 an individual one of a set of transversely spaced connector pin channels 30*a*. A corresponding set of connector pin channels 30*b* is formed towards the rear of member 14 such that the slots 28*b* at the bottoms of those channels are open towards the rear and bottom of such member.

The plug connector member 18 has formed therein front and rear sets of connector pin channels 31*a*, 31*b* corresponding to and vertically aligned with, respectively, channels 30*a*, 30*b* and similar thereto excepting that, since the plug connector 12 has no matrix block, the channels 31*a*, 31*b* lack passages corresponding to the passages 25*a*, 25*b* forming part of the channels 30*a*, 30*b* of the jack connector.

The channels 30 of jack connector 11 and the channels 31 of plug connector 12 each contain a corresponding one of, respectively, a set of female connector pins 35 and a set of male connector pins 36 received in, respectively elements 11 and 12 and the details of which will now be described.

Figure 5:
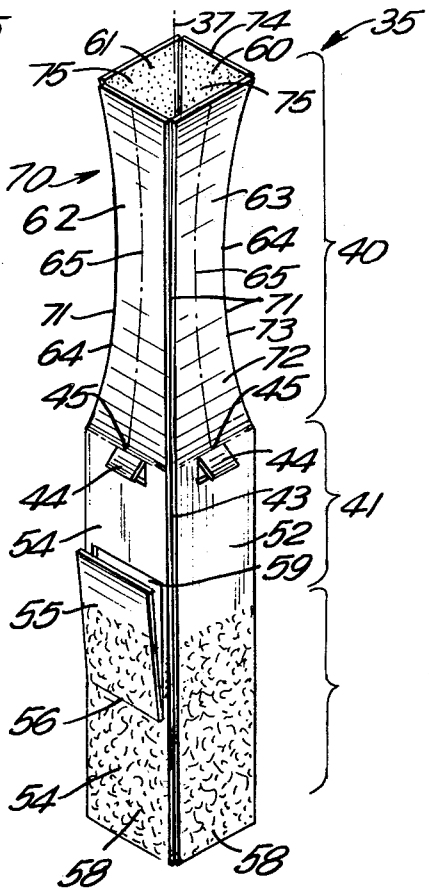
FIG. 5 is a rear isometric view of one of the female connector pins shown in FIG. 2.
Figure 4:
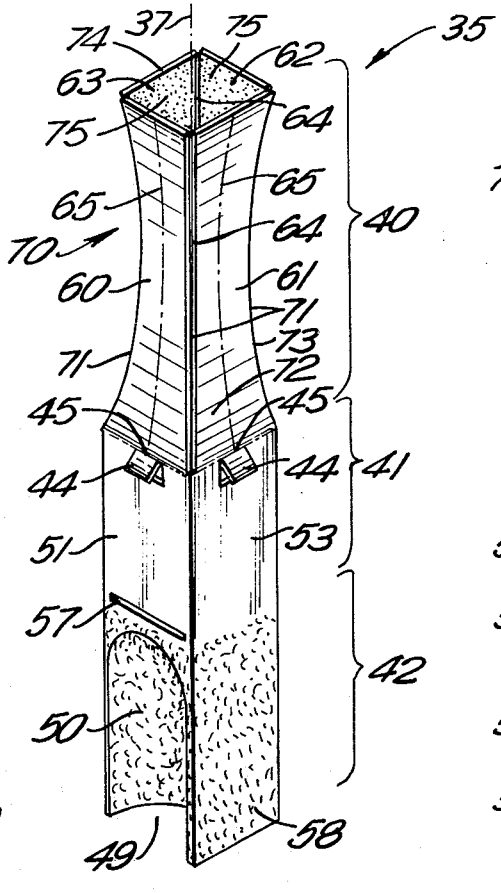
FIG. 4 is a front isometric view of such a female pin.

Referring to FIGS. 4 and 5, the female pin 35 is in the form of a longitudinally elongated member having a central longitudinal axis 37 and divided into an upper contact section 40, a mid-section 41 and a lower terminal section 42.

The mid-section 41 is in the form of a prismatic tube having, in planes normal to the axis 37 of pin 35, a polygonal cross-section which in the present embodiment is in the form of a square, although such cross-section may be of different polygonal shape as, for example, in the form of an oblong rectangle. The tube constituting mid-section 41 is closed around its periphery except at one edge of the tube's prismatic surface at which the continuity of such surface is interrupted by a discontinuity of zero or greater width in the form of an unbonded longitudinal seam 43 extending the entire length of the mid-section from the terminal section 42 to the contact section 40. The presence of such seam inherently results from the manufacture, later described, of the pin 35 from a piece of strip. At its top, the mid-section 41 has four forward motion stop tabs 44 formed as cut-outs from the four walls of the mid-section such that the tabs 44 are connected to wall portions of the pin 35 along transverse juncture lines 45 from which the tabs 44 slant outwardly in the downward direction to project outward of such wall portions. The term "lines" as used herein for juncture lines 45 and other juncture lines, fold lines and the like as to be understood as meaning an elongated region which can reasonably be thought of as corresponding to a line rather than a line in the geometric sense.

The terminal section 42 of pin 35 is, in general, an extension of mid-section 41 in that section 42 is likewise in the form of a prismatic tube of polygonal cross-section, and the prismatic envelope of which is closed except at one edge at which the envelope is rendered discontinuous by the unbonded seam 43. In contrast, however, to the mid-section, the terminal section 42 provides therein a trough for reception of solder and provides, moreover, a barrier for inhibiting liquid solder or solder flux in such trough from reaching the seam 43 and wicking along that seam into the contact section 40. In the particular embodiment shown by FIGS. 4 and 5, such trough is afforded by the interior of a depression 49 formed in the front wall 51 of the terminal section so as to be non-adjacent to seam 43. The mentioned barrier is afforded by the imperforate portion 50 of wall 51 in which depression 49 is formed so as to be bounded by that portion. Because such wall portion 50 is interposed in the direction normal to wall 51 between the seam 43 and the space within depression 49 in which liquid solder (and perhaps some liquid flux) is deposited in the course of use of pin 35, there is no way by which any of such liquid material can flow on the inside of terminal section 42 from its place of deposition in depression 49 to the seam 43 so as to be capable thereafter of wicking along the seam into the contact section 40. Further, since, on the outside of terminal section 42, the seam 43 is separated from the depression 49 not only by the portions of wall 51 on opposite transverse sides of that depression but also by, on the left-hand side of that wall, the width of the adjacent wall 52 and, on the right-hand side of that wall, the combined widths of the adjacent wall 53 and the back wall 54 of the terminal section, the paths over which liquid material in depression 49 would have to travel outside the terminal section to reach seam 43 are so long that, even if any of such material were to migrate out of that depression onto the outer wall surface of the terminal section, such material would, in most instances, stop short in its travel of reaching seam 43. Accordingly, the described portion 50 of wall 51 is effective by virtue of its character and location to inhibit solder and/or solder flux from wicking into the contact section of pin 35. From this, it follows that the above-described difficulties in soldering a pin made from strip to a lead have been obviated in pin 35 and that, accordingly, such pin may, at one and the same time and by virtue of the combination of its solder-receiving trough and solder flow barrier, be both originated from strip material and, as a practical matter, be readily and conveniently attachable by soldering to a lead or leads in commercial applications of the pin.

To further minimize, however, the possibility of liquid material in depression 49 from migrating on the outside of terminal section 42 upward past that section, such section has formed in its front wall 51 at a short distance above depression 49 a transverse slot 57 providing a barrier to such upward migration.

It will be noted that depression 49 has the shape of a scoop so as to be open not only to one side of the terminal section 42, but also at its bottom. It follows that a lead to be attached to pin 35 can be led into depression 49 through its bottom opening so that such lead can be conveniently disposed laterally inward of the front wall 51 of the terminal section of the pin.

To promote the adhesion of solder deposited in depression 49 to the bounding wall portion 50 of that depression, the terminal section 42 is coated with a solderability promoting layer 58 of, for example, gold or a tin-lead composition. Such layer 58 is restricted to the terminal section 42 and does not extend into the mid-section 41 so as to cover the strip material of the mid-section.

Besides its forward motion stop tabs 44, pin 35 has a reverse motion stop tab 55 cut out from the rear wall 54 of the pin's terminal section 42 to be connected with that wall only along a transverse juncture line 56. As shown, tab 55 is bent to slant outwardly from such line in the upward direction so as to leave behind in that wall a window 59 including the space occupied by the tab before it was bent out. The tab 55 is resilient in that, if forced back into window 59, the tab will, when released, spring back to its shown slanted position. Preferably, tab 55 is formed on the terminal section on the side thereof laterally opposite from depression 49 so as to facilitate formation of both the tab and depression in the same section of the pin while leaving intact the walls 52 and 53 on opposite sides of wall 51 in which the depression is formed to thereby minimize the chance of crumpling of the terminal section when depression 49 is made by deep drawing or the like as later described herein.

The contact section of female pin 35 comprises four petals or fingers 60, 61, 62, 63 integral with the tops of the four sides of mid-section 41 along the transverse juncture lines 45, the fingers projecting upward from those juncture lines away from that mid-section. Each of the petals has two arcuate longitudinal edges 64 which are on transversely opposite sides of the center line 65 of the petal, and which are each concavely curved or bowed so as to be nearer that center line at the longitudinal center of the edge than at its opposite ends. Further, the four petals are bent to each have a curved configuration which conforms to a cylindric surface having, as its directrix, the center line of the petal and, as its generatrix, a moving line which at all times intersects such directrix and is normal to the plane passing through such center line and to the axis 37 of the pin. The curvature of the petals 61–63 is so selected that the spacing, if any, between adjacent edges respective to adjacent petals is, for all edges of all petals, substantially uniform over the full lengths of those edges. The result is that the contact section 40 of the pin 35 takes the form of a hollow or "box" contact 70 having four longitudinal unbonded seams 71 running from its bottom to its top, and having a square cross-section which varies as a function of the longitudinal displacement of the cross-section from the mid-section 41 of the pin. The variation is such that contact 70 from its base 72 tapers convergently in cross-section from the mid-section 41 to a waist 73 at the longitudinal center of such contact and, upward of that waist, the contact tapers divergently in cross-section to its top 74 so as to provide a flaring upper end for the contact. By virtue of such construction of the female contact 70, the contact is resilient in the sense that it can expand in cross-section symmetrically out from the axis 37 of pin 35 in order to accomodate insertion therein of a male contact as shown in FIG. 2. Also, the female contact as a whole can resiliently deflect somewhat in relation to the normal axis of the pin in order to adjust to a male contact in instances where the respective axes of the two contacts are not quite coaxial.

The strip material forming box contact 70 is coated on the interior of the contact by, say, electroplating, with a layer 75 of corrosion resistant material from the top 74 of the contact past its waist 73 and down close to its juncture with mid-section 41. That material usually comprises a precious metal such as, for example, gold or palladium. The presence of such layer assures that low contact resistance with a similarly coated male contact will be maintained despite exposure of the contacts to environmental conditions which would tend to tarnish them and thereby increase their contact resistance or result as a practical matter in an open circuit between the female contact and male contact. The fact that layer 75 is selectively restricted to the interior of the contact section of the pin 35 and does not extend to its mid-section lowers the cost of the pin in that the amount of precious metal thereon is reduced as compared to what it would be were more of the pin to be coated with such metal.

Figure 3:
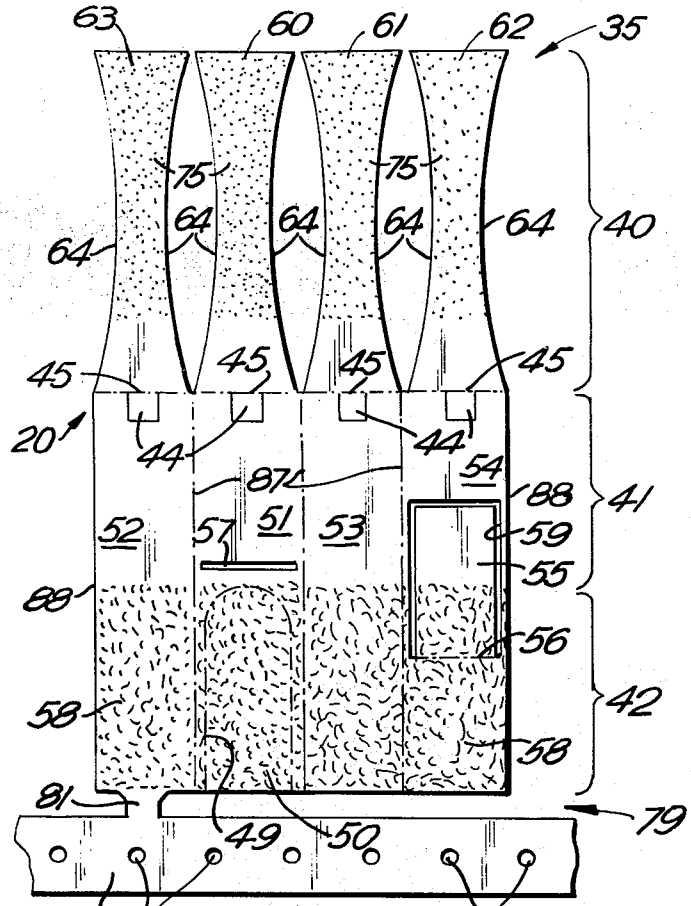
FIG. 3 is a fragmentary plan view of a strip of electroconductive material from which the female pins of FIG. 2 may be formed.
Figure 6:
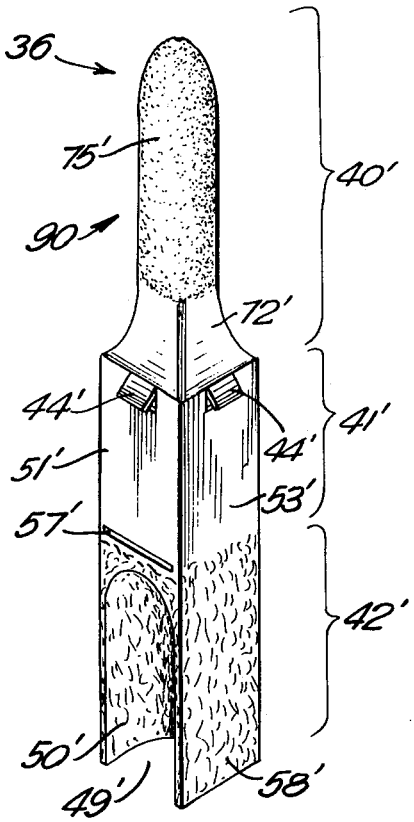
FIG. 6 is a front isometric view of one of the male connector pins shown in FIG. 2.
Figure 7:
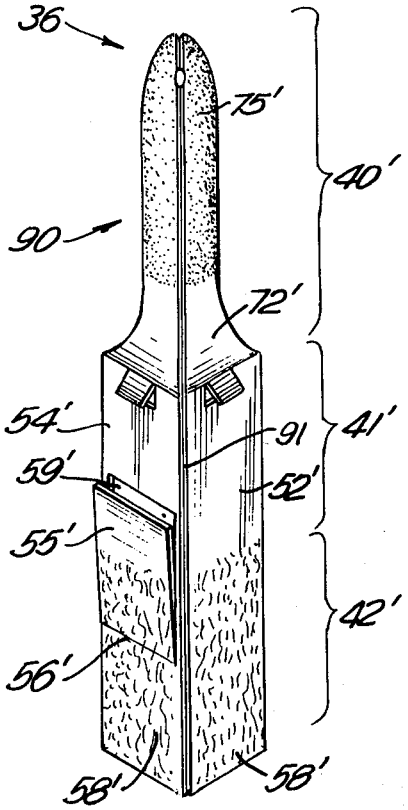
FIG. 7 is a rear isometric view of such a male pin.
Figure 8:
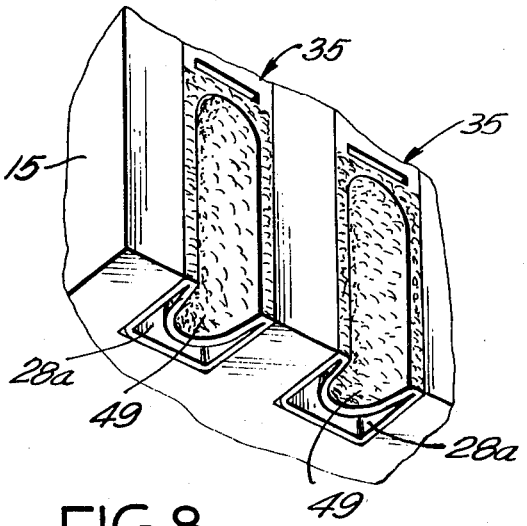
FIG. 8 is an enlarged fragmentary isometric view of a part of the FIG. 1 connector assembly to which leads are to be attached; such FIG. 8 view being taken as indicated by the arrows "8" in FIGS. 1 and 2.

The female connector pin 35 is made from an elongated strip 79 of electroconductive material of which part is shown in fragmentary view in FIG. 3 to which reference is now made. More particularly, pin 35 is made from a unitary piece 80 of that strip, the piece being depicted in FIG. 3 as being attached by a neck 81 to a central web part 82 of the strip which has pilot holes 83 therein, and which is used to transport piece 80 and similar pieces similarly attached to web 82 past a series of stations at which forming operations are performed on those pieces. For convenience of comparison, portions of piece 80 which will become the features of the finished pin 35 are given the same reference numerals in FIG. 3 as those features have in FIGS. 4 and 5.

From the description already given of the finished female pin, the manner in which such pin is made from piece 80 should, for the most part, be self-evident and, hence, will not be treated herein in great detail. At the stage of manufacture of the pin illustrated in FIG. 3, the piece 80 has acquired its complete configuration necessary for forming it into pin 35. Also at such stage, the cutout lines necessary to provide the forward motion stop tabs 44 and the reverse motion stop tab 55 have been made with, as shown, a small gap being provided between the free edges of tap 55 and the window 59 surrounding it to thereby permit the tab when bent out to be resiliently deflected back into the space framed by that window without binding of the tab. Still further, the solderability promoting layer 58 and the corrosion resistant layer 75 have been coated on piece 80 and similar pieces on the strip 79 by selective striping of the strip with such layers.

Subsequent to the stage of manufacture shown in FIG. 3, further operations are, in appropriate order,